US007703939B2

(12) United States Patent
Wilcox et al.

(10) Patent No.: US 7,703,939 B2
(45) Date of Patent: Apr. 27, 2010

(54) LIGHT FIXTURE SUPPORT ASSEMBLY

(75) Inventors: Kurt S. Wilcox, Libertyville, IL (US); Brian L. Kinnune, Racine, WI (US); Russell S. Schultz, Racine, WI (US); Steven R. Walczak, Hales Corners, WI (US)

(73) Assignee: Ruud Lighting, Inc., Racine, WI (US)

( * ) Notice: Subject to any disclaimer, the term of this patent is extended or adjusted under 35 U.S.C. 154(b) by 221 days.

(21) Appl. No.: 11/677,531

(22) Filed: Feb. 21, 2007

(65) Prior Publication Data

US 2008/0198609 A1 Aug. 21, 2008

(51) Int. Cl.
*F21S 6/00* (2006.01)

(52) U.S. Cl. ..... 362/147; 362/153.1; 362/410; 362/431; 362/432

(58) Field of Classification Search ..... 362/147, 362/153, 153.1, 410, 431, 432
See application file for complete search history.

(56) References Cited

U.S. PATENT DOCUMENTS 2,612,600 A * 9/1952 Yonkers ..... 362/341
2,886,699 A * 5/1959 Harling ..... 362/223
3,478,200 A * 11/1969 Hewson ..... 362/368
4,317,164 A 2/1982 Karaktin
4,398,239 A * 8/1983 de Vos et al. ..... 362/263
4,729,073 A 3/1988 Klaus
5,258,898 A 11/1993 Thornton
5,357,414 A 10/1994 Dane et al.
6,467,928 B2 10/2002 Crelin

* cited by examiner

*Primary Examiner*—Sharon E Payne
(74) *Attorney, Agent, or Firm*—Jansson Shupe & Munger Ltd.

(57) ABSTRACT

In an embodiment of a light fixture support assembly for securing a light fixture to a fixed surface, the assembly includes a fixture-support member and a surface-attachment member. The fixture-support member has proximal and distal ends and also includes walls defining a compartment and further defining a first opening at the proximal end of the fixture-support member for communication with the surface-attachment member. The walls further define a second opening for communication with the light fixture. The fixture-support assembly also has a neck portion extending from the proximal end and the neck portion has a flange portion extending from it. The surface-attachment member includes a proximal end attached to the fixed surface and a distal end configured to engage the neck portion, whereby the fixture-support member is supported by the surface-attachment member when the neck portion is inserted into the fixture-support member.

17 Claims, 5 Drawing Sheets

LIGHT FIXTURE SUPPORT ASSEMBLY

FIELD OF THE INVENTION

This invention is related generally to light-fixture supports and, more particularly, to light-fixture support assembly that allows a first piece to be mounted to a surface and a second piece to be attached to the first piece to support the light fixture.

BACKGROUND OF THE INVENTION

In the field of lighting, light fixtures are needed in many different settings and, for area lighting, a raised position usually best allows efficient use of light. In that view there are many known designs and methods for supporting a light fixture from a fixed surface, such as from a light pole or a wall. However, as larger lights are needed for larger areas, light fixtures increase in size and weight and are difficult to handle and install, especially at height.

Installation of a light fixture includes attaching wires from the wall or light pole to the fixtures. Therefore, a light fixture that includes a support structure that is already attached remains difficult to wire when the installer has to worry at the same time about attaching the entire light system to the wall. Furthermore, the supports are generally designed with each light fixture, so that a single manufacturer may have no general purpose mount that can be utilized with a variety of fixtures.

While a vast array of mounting and supporting structures have been developed, a need exists for an improved light fixture support system and allows for easy installation and compatibility with many different light fixture designs.

OBJECTS OF THE INTENTION

It is an object of the invention to provide a light-fixture support assembly overcoming some of the problems and shortcomings of the prior art, including those referred to above.

Another object of the invention is to provide a light-fixture support assembly that allows one part to be attached to a fixed surface first while a second part including the light fixture can be quickly and easily attached to the first part once it is mounted.

Another object of the invention is to provide a light-fixture support assembly that allows easy access to the wiring once it is in place.

Another object of the invention is to provide a light-fixture support assembly that allows a universal connection between the light fixture and the surface it is to be mounted to.

How these and other objects are accomplished will become apparent from the following descriptions and the drawings.

SUMMARY OF THE INVENTION

In an embodiment of a light fixture support assembly for securing a light fixture to a fixed surface, the assembly includes a fixture-support member and a surface-attachment member. The fixture-support member has proximal and distal ends and also includes walls defining a compartment and further defining a first opening at the proximal end of the fixture-support member for communication with the surface-attachment member. The walls further define a second opening for communication with the light fixture. The fixture-support assembly also has a neck portion extending from the proximal end and the neck portion has a flange portion extending from it. The surface-attachment member includes a proximal end attached to the fixed surface and a distal end configured to engage the neck portion, whereby the fixture-support member is supported by the surface-attachment member when the neck portion is inserted into the fixture-support member.

In another embodiment, the light fixture support assembly includes a neck portion defining a channel in communication with the first opening.

In a further embodiment, the compartment is at least partially open on a top side of the fixture-support member and the assembly further includes a cover piece sized to cover the at least partially open top side of the fixture-support member. The cover piece is releasably connected to the fixture-support member covering the open top side.

In yet another embodiment, the light fixture defines a passage and the light fixture is attached to the fixture-support member whereby the second opening of the fixture-support member and the passage of the light fixture are in communication.

In a still further embodiment, the surface-attachment member includes walls which define a surface-attachment member compartment. The surface-attachment member compartment is at least partially open on a top side of the surface-attachment member.

In another embodiment, the distal end of the surface-attachment member is configured to define a support opening that is dimensioned wider than the neck portion and narrower than the flange portion In a further embodiment, the light fixture support assembly includes a locking member which is releasably connected to the surface-attachment member over the neck portion when the neck portion is inserted into the support opening.

In yet another embodiment, the light fixture support assembly includes a surface-attachment member cover piece sized to cover the at least partially open top side of the surface-attachment member. The surface-attachment member cover piece is releasably connected to the surface-attachment member covering the at least partially open top side of the surface-attachment member.

DETAILED DESCRIPTION OF THE PREFERRED EMBODIMENTS

Figure 1:
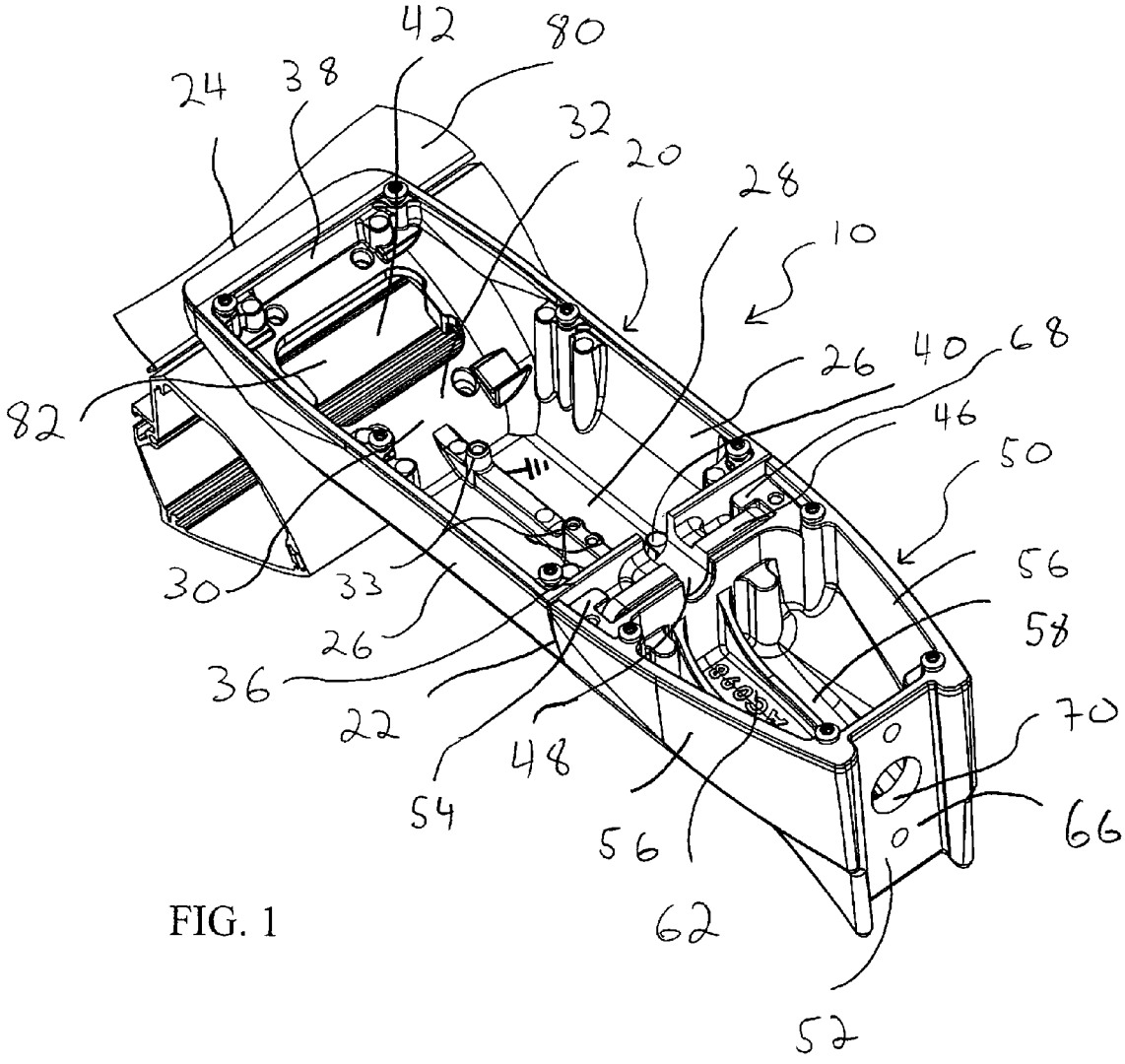
FIG. 1 is a perspective view of a preferred embodiment of light-fixture support assembly.

FIG. 1 illustrates a preferred embodiment of a light fixture support assembly 10. The support assembly 10 includes two primary sub-assemblies: a fixture-support member 20 that is connected to a light fixture 80 and a surface-attachment member 50 that is attached to a fixed surface (not shown). In this preferred embodiment the surface-attachment member 50 and fixture-support member 20 are made from die-cast aluminum, however any suitable material could be used depending on the weight of the light fixture to be supported and on the conditions under which the support is to be used such an interior or exterior usage.

The fixture-support member 20 has a proximal end 22 and a distal end 24. The fixture-support member 20 includes two opposite side walls 26 which are connected by a bottom wall 28 a proximal end wall 36 and a distal end wall 38. The bottom wall 28 includes a sloping section 30 that slopes up at the distal end 24. The side walls 26, bottom wall 28, proximal end wall 36 and distal end wall 38 define a compartment 32 which is open on a top end 34 of the fixture-support member 20. The proximal end wall 36 further defines a first opening 40 that, as further described below, allows communication between the compartment 32 of the fixture-support member 20 and the surface-attachment member 50. The fixture-support member 20 can further include mounting points 33 extending into the compartment 32. These mounting-points can be utilized for mounting specialized controls or equipment (not shown) within the compartment.

Figure 2:
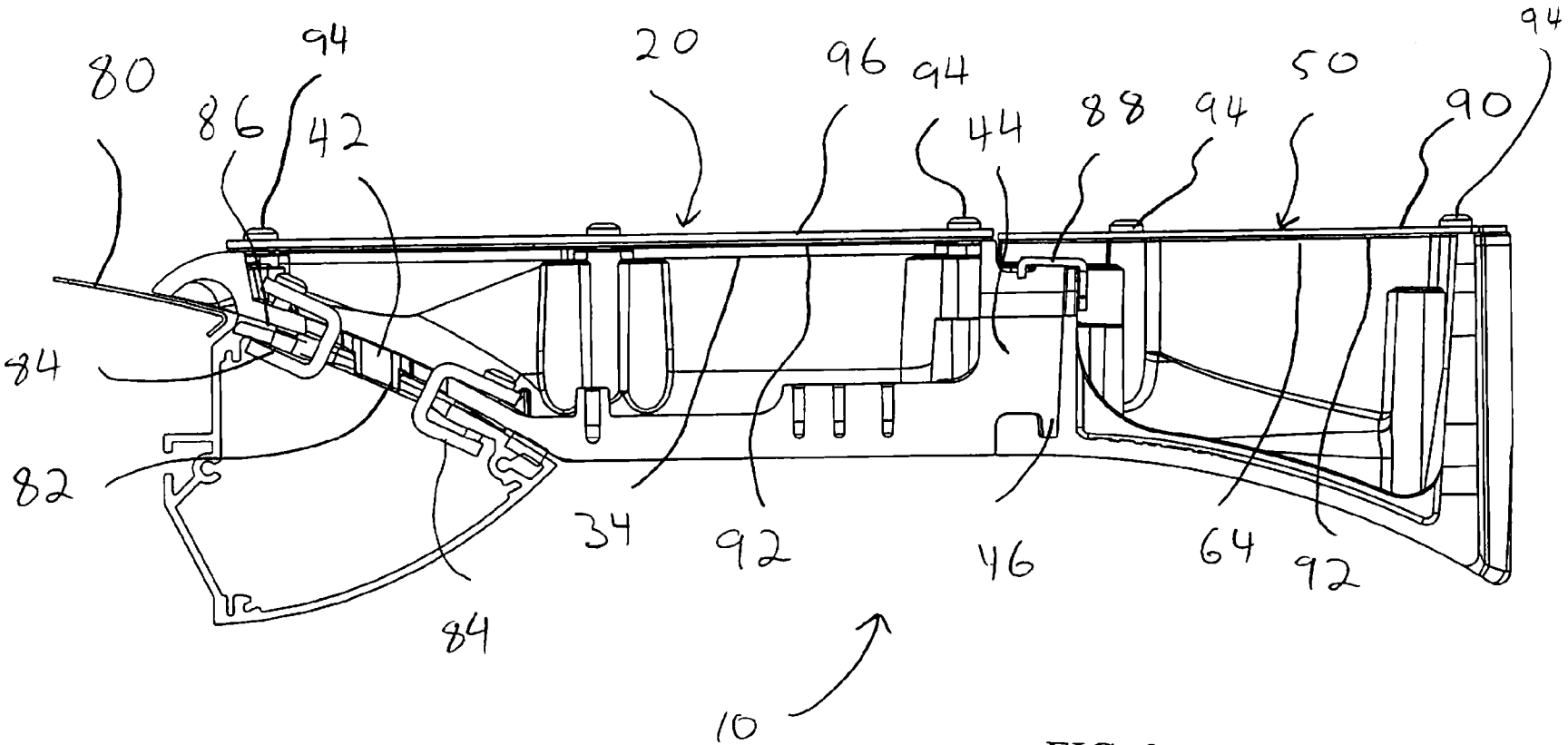
FIG. 2 is a cross-sectional view, without cross-hatching, of the light-fixture support assembly taken along the line 2-2 shown in FIG. 5.

In this preferred embodiment, the sloping section 30 of the bottom wall 28 defines a second opening 42 that allows communication between the compartment 32 and the light fixture 80. The light fixture 80 defines a light-fixture opening 82 that allows wire (not shown) or other structure to pass through the compartment and into the light fixture 80. The light fixture 80 is aligned so that the light fixture opening 82 and the second opening 42 are aligned with each other. Turning now to FIG. 2, the light fixture 80 and the fixture-support member 20 are connected together via U-shaped clamps 84 which connect the pieces together at the aligned second opening 42 and light fixture opening 82. In this preferred embodiment, a gasket 86 is placed between the light fixture 80 and the fixture-support member 20 to provide a weather-tight seal between them.

Figure 3:
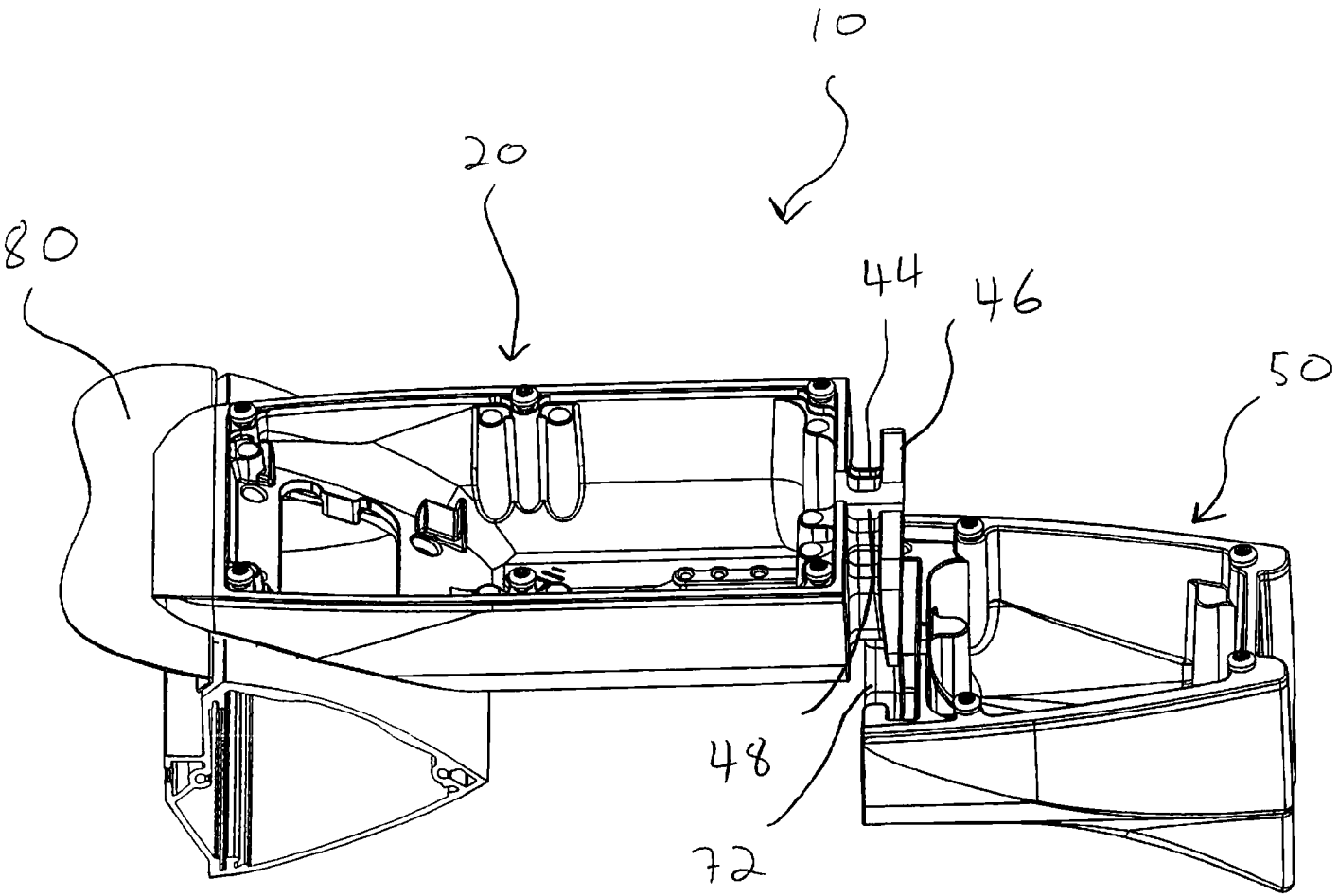
FIG. 3 is a side perspective view of the light-fixture support assembly of FIG. 1 with the fixture-support member and surface-attachment member separated.

As best seen in FIG. 3, the fixture-support member 20 further includes a neck portion 44 extending out from the proximal end 22 of the fixture-support member 20. The neck portion 44 allows for the simple connection between the fixture-support member 20 and the surface-attachment member 50. The neck portion 44 includes an outwardly extending flange portion 46 that is wider than the remainder of the neck portion 44. In this preferred embodiment the neck portion 44 is integral with the fixture-support member 20 and defines a channel 48 that is in communication with the first opening 40. However, in other embodiments, the neck portion 44 could be arranged such that it does not partially block the first opening 40 and therefore, no channel 48 is needed.

Turning again to FIG. 1 the surface-attachment member 50 has a proximal end 52 and a distal end 54 and is of a one-piece construction. The surface-attachment member 50 includes two opposite side walls 56 which are connected by a bottom wall 58, a proximal end wall 66 and a distal end wall 68. The side walls 56, bottom wall 58, proximal end wall 66 and distal end wall 68 define a compartment 62 of the surface-attachment member 50 which is open on a top end 64 of the surface-attachment member 50. The proximal end wall 66 defines a wire opening 70 to allow wires (not shown) to pass into the light fixture support assembly 10.

As best seen in FIG. 3, the distal end wall 68 of the surface-attachment member 50 is configured to accept the neck portion 44 of the fixture-support member 20. In this preferred embodiment, the distal end wall 68 of the surface-attachment member 50 defines a support opening 72 that is dimensioned wider than the neck portion 44 and narrower than the flange portion 46 of the neck portion 44.

In use, the proximal end wall 66 of the surface-attachment member 50 is attached to a fixed surface (not shown) such as a wall or a light pole via any known means such as bolts or screws. Wiring (not shown) can then be pulled through the wire opening 70 and into the compartment 62 of the surface-attachment member 50. The surface-attachment member 50 is then secured and capable of supporting the remainder of the assembly 10 and the light fixture 80.

Figure 4:
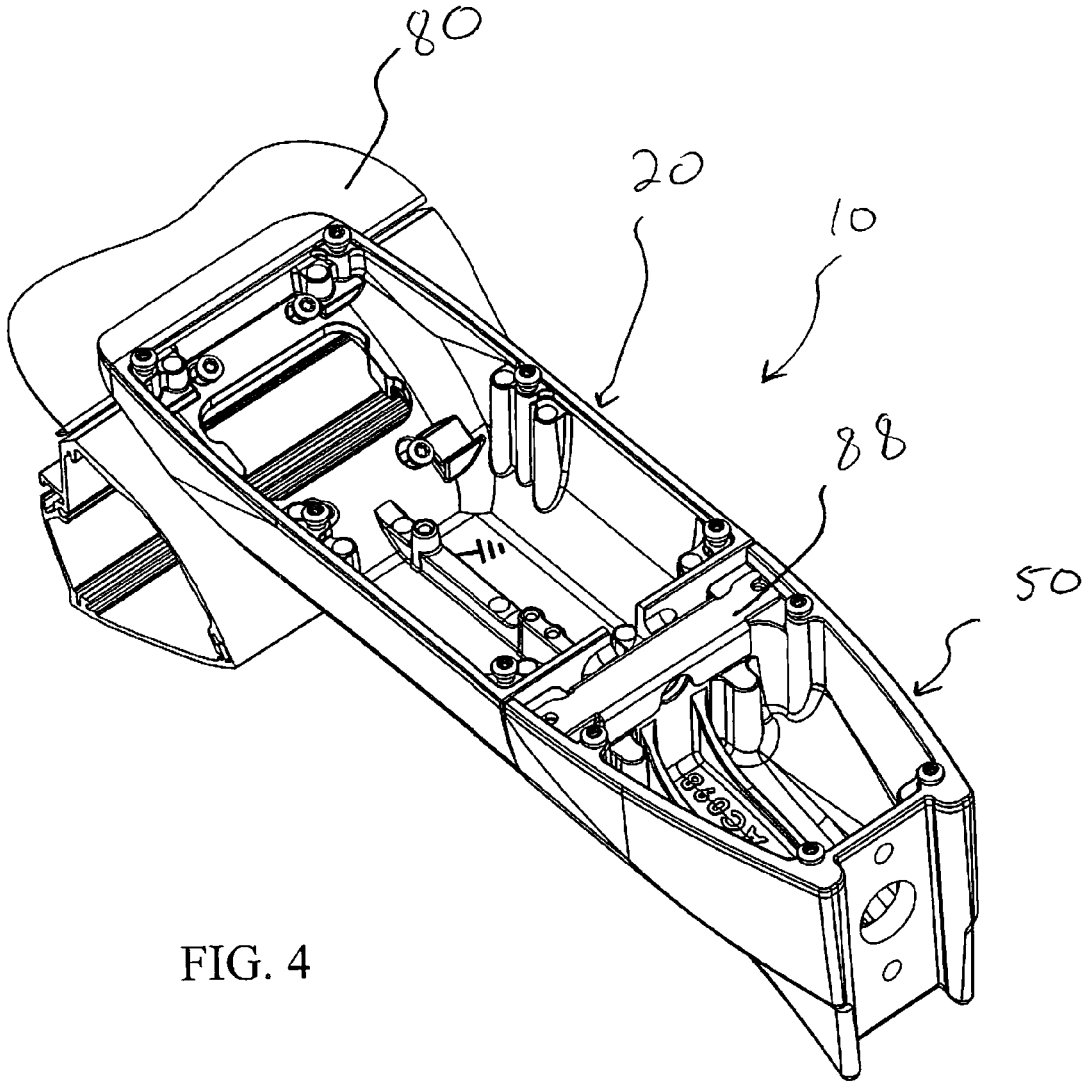
FIG. 4 is a perspective view of the light-fixture support assembly of FIG. 1 and further including a locking member.

The neck portion 44 of the fixture-support member 20 is then arranged over the distal end 54 of the surface-attachment member 50 as seen in FIG. 3 and the neck portion 44 is lowered into the support opening 72 so that the flange portion 46 is within the compartment 62 of the surface-attachment member 50. Preferably, the neck portion 44 does not extend out of the open top end 64 of the compartment 62 of the surface-attachment member when the neck portion 44 is fully inserted into the support opening 72. Wires can then be arranged in the channel 48 to enter into the compartment 32 of the fixture-support member 20 via the first opening 40 and be connected to wires from the light fixture 80 that enter into the compartment 32 of the fixture-support member 20 at the second opening 42. As shown in FIG. 4, a locking member 88 is then placed over the neck portion 44 and secured to the surface-attachment member 50, whereby the connection between the fixture-support member 20 and the surface-attachment member 50 is locked in place.

Figure 5:
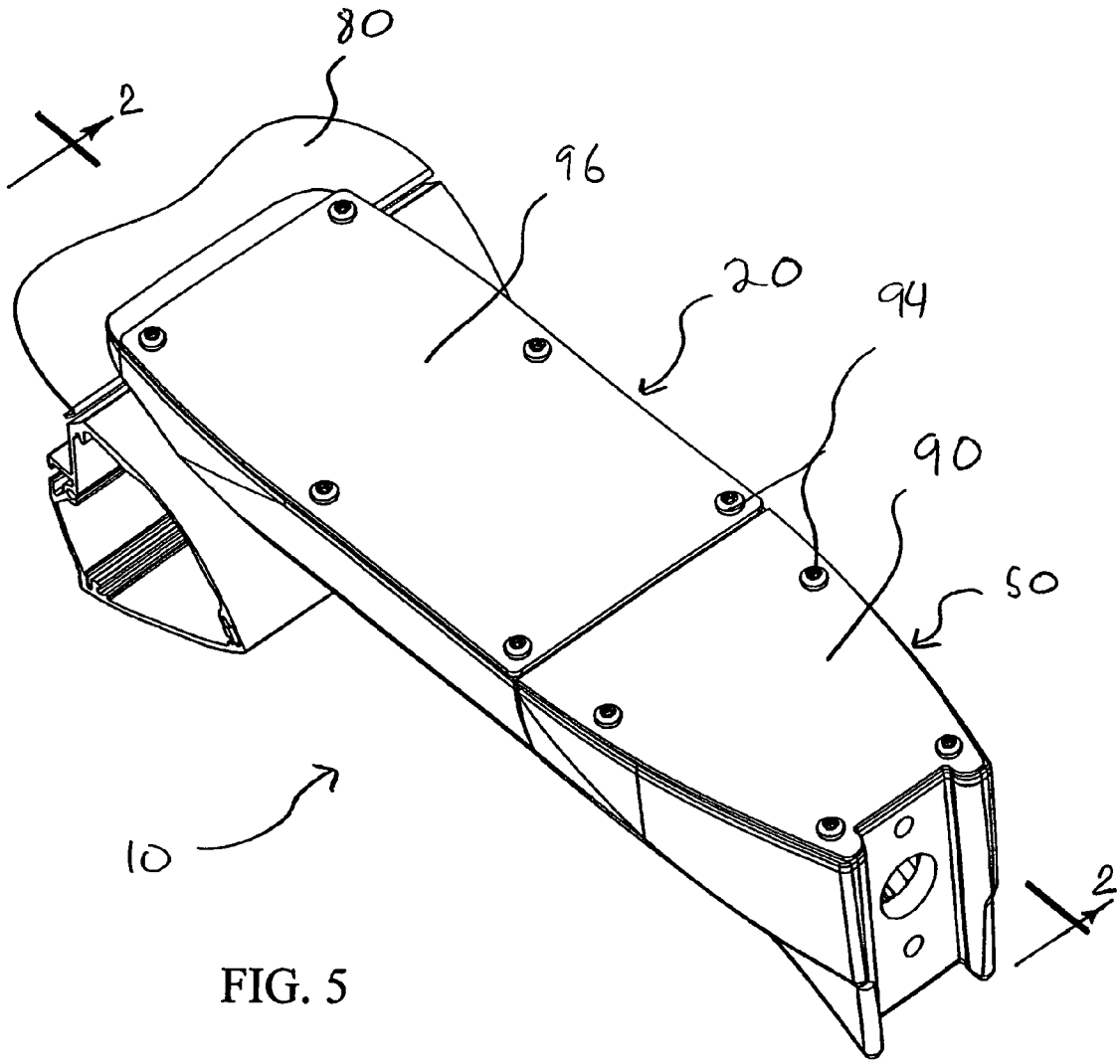
FIG. 5 is a perspective view of the light-fixture support assembly of FIG. 1 and further including cover pieces.

A surface-attachment member cover piece 90, as seen best in FIG. 5, can be placed over the open top end 64 of the surface-attachment member. As seen in FIG. 2, the surface-attachment member cover piece 90 preferably includes a seal or gasket 92 which provides a weather-tight seal between the surface-attachment member cover piece 90 and the surface-attachment member 50. The surface-attachment member cover piece 90 is then fastened in place via screws 94 or other fastening means.

A fixture-support member cover piece 96, as seen best in FIG. 5, can be placed over the open top end 64 of the fixture-support member. As seen in FIG. 2, fixture-support member cover piece 90 preferably includes a seal or gasket 92 which provides a weather-tight seal between the fixture-support member cover piece 96 and the fixture-support member 20. The fixture-support member cover piece 96 is then Fastened in place via screws 94 or other fastening means. In other embodiments, the fixture-support member cover piece 96 could include holes (not shown) to allow electronic measuring devices inside the compartment 32 of the fixture-support member 20 to extend outside the compartment 32.

While the principles of the invention have been shown and described in connection with specific embodiments, it is to be understood that such embodiments are by way of example and are not limiting.

We claim:

1. A light-fixture support assembly for securing a light fixture to a fixed surface, the assembly comprising a fixture-support member and a surface-attachment member, wherein:

the fixture-support member has walls defining a compartment and extends between a distal end secured to the light fixture and an opposite proximal end engaging the surface-attachment member, the proximal end including an outwardly-extending substantially-horizontal neck which supports a flange portion thereabout; and the surface-attachment member has an at least partially-open top, a fixed-surface end attachable to the fixed surface and a neck-engaging end defining a support opening dimensioned wider than the neck and narrower than the flange portion, the open top receiving the neck within the support opening thereby securing the fixture-support member to the surface-attachment member.

2. The light-fixture support assembly of claim 1 wherein:

the proximal end of the fixture-support member defines a first opening for communication with the surface-attachment member; and the neck defines a channel in communication with the first opening.

3. The light-fixture support assembly of claim 1 wherein the neck and flange portion are entirely within the surface-attachment member when the neck is inserted into the support opening.

4. The light-fixture support assembly of claim 1 wherein the neck is integral with the fixture-support member.

5. The light-fixture support assembly of claim 1 wherein:

the fixture-support member includes a distal-end wall which defines a second opening for communication with the light fixture; and the light fixture defines a passage in communication with the second opening of the fixture-support member.

6. The light-fixture support assembly of claim 5 wherein the fixture-support member is connected to the light fixture via a clamp.

7. The light-fixture support assembly of claim 6 wherein the clamp is U-shaped such that it extends through the light-fixture passage and the second opening to sandwich a light-fixture wall and the fixture-support-member distal-end wall between U-shaped clamp walls.

8. The light-fixture support assembly of claim 5 further including a gasket between the light fixture and the fixture-support member.

9. The light-fixture support assembly of claim 1 wherein the compartment of the fixture-support member is at least partially open on a top side of the fixture-support member, the assembly further including a cover piece sized to cover the at least partially open top side of the fixture-support member and releasably connected thereto.

10. The light-fixture support assembly of claim 9 wherein the connection between the cover piece and the fixture-support member is a weather-tight seal.

11. The light-fixture support assembly of claim 10 wherein the cover piece is releasably attached via fasteners.

12. The light-fixture support assembly of claim 9 wherein the surface-attachment member includes two opposite side walls connected by a bottom wall, the walls defining the surface-attachment-member compartment.

13. The light-fixture support assembly of claim 12 wherein the surface-attachment member is of one-piece construction.

14. The light-fixture support assembly of claim 1 further including a locking member which is releasably connected to the surface-attachment member over the neck when the neck is inserted into the support opening.

15. The light-fixture support assembly of claim 12 further including a surface-attachment member cover piece sized to cover the at least partially open top side of the surface-attachment member and releasably connected thereto.

16. The light-fixture support assembly of claim 15 wherein the connection between the surface-attachment member and its cover piece is a weather-tight seal.

17. The light-fixture support assembly of claim 9 wherein the fixture-support member further includes mounting points extending from the walls into the compartment.

* * * * *

UNITED STATES PATENT AND TRADEMARK OFFICE

CERTIFICATE OF CORRECTION

PATENT NO. : 7,703,939 B2
APPLICATION NO. : 11/677531
DATED : April 27, 2010
INVENTOR(S) : Wilcox et al.

It is certified that error appears in the above-identified patent and that said Letters Patent is hereby corrected as shown below:

On the Title page, Item (54), Title: delete "LIGHT FIXTURE" and insert --LIGHT-FIXTURE--.

In column 1, line 1, delete "LIGHT FIXTURE" and insert --LIGHT-FIXTURE--.

In column 4, line 39, delete "Fastened" and insert --fastened--.

Signed and Sealed this

Nineteenth Day of October, 2010

David J. Kappos

David J. Kappos
*Director of the United States Patent and Trademark Office*